United States Patent [19]

Lundin

[11] 3,948,651

[45] Apr. 6, 1976

[54] ALLOYS OF ALUMINUM-LEAD-COPPER

[76] Inventor: Charles E. Lundin, P.O. Box 624, Evergreen, Colo. 80439

[22] Filed: Feb. 3, 1971

[21] Appl. No.: 112,421

[52] U.S. Cl. ..... 75/138; 75/68 R; 75/139; 75/163

[51] Int. Cl.[2] ..... C22C 1/02

[58] Field of Search ..... 75/139, 138, 163, 68; 148/32, 32.5

[56] References Cited

UNITED STATES PATENTS

| | | | |
|---|---|---|---|
| 1,959,029 | 5/1934 | Kempf et al. | 75/138 |
| 2,026,549 | 1/1936 | Dean et al. | 75/139 |
| 3,410,331 | 11/1968 | Miller et al. | 75/138 |
| 3,544,314 | 12/1970 | Bazley | 75/163 |
| 3,556,779 | 1/1971 | Turkisher et al. | 75/163 |

*Primary Examiner*—R. Dean

[57] ABSTRACT

This disclosure is directed to an aluminum-lead-copper alloy and to methods for its preparation. The alloy may comprise, for example, 50 to 95 percent aluminum, with the remainder being copper and lead. The lead and copper may be separately melted and poured into superheated molten aluminum or preferably, lead-copper alloys may be made and added to the molten aluminum. The aluminum-lead-copper alloy is intended to have a fine and even dispersion of the phases and properties which make it suitable for bearings and bushings. Aluminum-lead alloys are also disclosed herein.

4 Claims, No Drawings

ALLOYS OF ALUMINUM-LEAD-COPPER

BACKGROUND

Alloys of lead and copper have been used for many years as bearings, such as in the automotive field. The alloy is considered to have a soft phase, which is substantially lead. reinforced by a network of copper. Apparently, in a lead-copper bearing, the lead squeezes out to form a film of soft metal on the surface of the hardener copper, and thus gives valuable frictional properties with a coefficient of friction lower than that of either the lead or copper. The alloy is, of course, quite dense and is often used as a lining on steel sheets. Some of the very facts that make the lead-copper alloys a good bearing material, make it a very difficult material to form or cast. The metals have limited liquid miscibility; there is an absence of the formation of compounds; and there is very limited solid solution. Segregation of the components of the alloy is a particular problem.

In contrast to the lead-copper alloy, aluminum is used largely as a structural metal due to its light weight, strength and excellent corrosion resistance. Attempts to alloy aluminum with other metals such as lead or copper have met with difficulties due to the insolubility of these metals in aluminum. The solubility of copper in aluminum is only 0.1% at room temperatures, but it is known that a somewhat larger amount can be kept dissolved in aluminum by addition in a molten state followed by rapid cooling. However, reheating of the alloy will then cause precipitation of the copper.

The difficulties encountered with lead are even greater since lead in the liquid state is not miscible with aluminum if the lead content exceeds 1.8% and the solubility of lead in aluminum is very low. Moreover, solid lead forms spheres within the body of solidified aluminum which break the continuity of the metal, particularly during machining.

It is, therefore, an object of this invention to provide an improved alloy comprising a major amount of aluminum and minor but significant amounts of lead and copper.

It is an object of the present invention to provide for an improved alloy which will overcome several problems which heretofore have existed in this art.

A further object is to provide improved processes for making an alloy of aluminum, lead and copper.

This invention is also directed to aluminum-lead alloys and to methods for making such alloys.

Other objects and advantages will be evident from, and will be set forth in conjunction with, the following detailed description of the invention.

The Invention

This invention is directed to an alloy of aluminum with lead and copper and other minor constituents. The invention is further directed to methods for making such alloys and to their use as bearing surfaces. Although the use of either copper or lead in aluminum causes considerable problems, it has been found that the addition of both metals, preferably alloyed, produces improvements in reducing segregation of the components.

Prior art attempts have been directed to producing substantially pure and uniformly homogeneous copper-lead alloys in order to provide alloys which have high thermal conductivity, low electrical resistivity and a low coefficient of friction. These properties are highly desirable for metals used to make bearings or as a bearing material and as a dry lubricant or as an additive to liquid or viscous lubricants made of petroleum or vegetable bases. However, many problems have not been solved by the prior art in attempting to make substantially pure and uniformly homogeneous coppper-lead alloys. A basic problem is the prevention of segregation of the copper and lead during the initial and subsequent remelts without the addition of ternary elements. This tendency to segregate has been a particularly difficult problem as the lead content rises above 20% of the total weight of the copper-lead alloy. Another problem associated with the use of prior alloys is that even if there is initial homogeneity, under high stress and temperature conditions, the lead has a tendency to segregate from the copper. A further problem associated with copper-lead alloys in the prior art is that the lead tends to segregate from the copper when it is being remelted and recast into other shapes and forms.

In the prior art, ternary materials in small amounts have been added to the lead-copper alloy to reduce segregation. Althought these additives have been of some effect in solving the homogeneity problem, they have also added qualities which made them less desirable as anti-friction bearing materials or as lubricants. For instance, by the addition of ternary materials, the coefficient of friction is increased, thermal conductivity decreased and electrical resistivity increased.

In contrast to the approach adopted in the prior art of adding small amounts of constituents to lead-copper alloys it has been found that this lead-copper alloy can be added to aluminum to impart thereto beneficial properties. Alternatively, lead and copper can be individually added to aluminum. Although the use of either lead or copper in aluminum causes considerable problems, the addition of both metals produces improvements with a surprising lack of segregation. Additional metals may be used for their well-known purposes, but they are not necessary to achieve homogeneity.

It has been found that by adding a lead-copper alloy, or by adding both metals to aluminum, an alloy can be made which comprises substantial amounts of these added metals.

Copper-lead alloys are produced for use in the present invention in varying proportions of copper and lead, and preferably with effective amounts of a homogeneity promoter. The copper lead alloys used in this invention are set forth in greater detail in copending patent applications: Ser. No. 706,640 filed Feb. 19, 1968 by Lundin and Turkisher, now U.S. Pat. No. 3,556,779; Ser. No. 53,953 filed July 10, 1970 by Lundin and Turkisher now U.S. Pat. No. 3,719,477,; and Ser. No. 62,338 filed Aug. 10, 1970 by Lundin, now U.S. Pat. No. 3,720,507, which are incorporated herein by reference. It has been found that the alloys of greatest utility for use with aluminum are preferably those which contain about 20% to 50% lead and the remainder copper. If the lubricating qualities of the alloy are to be increased, the proportion of lead should be increased, and substantial amounts of it can be used. If it is desirable to increase the strength of the material, a lesser proportion of lead should be utilized.

The homogeneity promoters used to make the copper-lead alloys comprise elemental carbon, such as graphite, in combination with a metal compound wherein the metal is an alkali metal, alkaline earth metal, or rare earth metal in the form of an oxide or carbonate.

The elemental carbon component is preferably finely powdered graphite. Although coarser carbon may be used, the larger particles tend to decrease the efficiency of the process, presumably due to reduced surface area to volume ratio. Other forms of carbon include bone-black, carbon-black, charcoal and the like.

The alkali metal compound may be lithium potassium or sodium (or other metals of Group Ia of the Periodic Table), preferably combined as a carbonate. The alkaline earth compound may be calcium, strontium or barium (or other metal of Group 2*a* of the Periodic Table) preferably combined as a carbonate. Combinations of alkali and alkaline earth compounds may be used, for example, a mixture of sodium and calcium carbonate. The terms "rare earths" and "rare earth carbonates" as used throughout this application are intended to include scandium, yttrium, lanthanum, and the lanthanides, the latter term encompassing those metals having atomic numbers from 58 to 71. The preferred rare earths are cerium and yttrium and mixtures thereof with lanthanum, praseodymium, samarium and europium. The preferred rare earth compounds are the halocarbonates, particularly the fluorocarbonates of the above metals. The carbonates and oxides of the rare earths are also suitable. The rear earth compounds may be used with or in place of the alkali and/or alkaline earth compounds. The amounts of homogeneity promoter used must be at least that amount which ensures formation of a uniformly dispersed mixture of lead and copper which does not segregate on solidification. A preferred effective range of the proportions has been found to be about 1–5 grams of carbon or graphite powder and about 3–15 grams of metal compound for each pound of alloy. Below this proportion, improvements in homogeneity are obtained, but the effect is less pronounced when a very minor amount of promoter is used. Higher amounts of the homogeneity promoter may be used, for example, up to 10 grams of graphite and 30 grams of the metal compound for each pound of alloy. Although these and even greater amounts provide an improved copper-lead alloy for use with aluminum the greater amounts are less attractive from an economic standpoint. The maximum proportion of the promoter is determined by characteristic requirements of the alloy, and economic considerations. The amount of additive incorporated into the copper-lead alloy is, in part, a function of the period during which the alloy is maintained in a molten state during formation and when added to aluminum. If the copper-lead alloy is to remain molten for several minutes or more, it is desirable to add greater amounts of additive, either initially or over a period of time.

Additional additives may be used in combination with the above-described homogeneity promoter. For example, from 1 to 10 grams of metal phosphate may be used, such as ortho lead phosphate, ortho cupric phosphate or ortho tin phosphate.

In one method of making the copper-lead alloy for use in the present invention, copper of the desired quantity is placed in a graphite crucible and brought to a temperature of 1250° – 1350°C. using an induction heater. When the copper is melted and has attained the appropriate temperature, as for example about 1275° C., the lead and the homogeneity promoter are added to the melt. Thereupon violent agitation of the liquid mixture ensues with the formation of gas. The temperature of the mixture is maintained for at least 1 minute and preferably 3 minutes with stirring for best results. The melt is then allowed to cool through its solidification temperature during which time the agitation continues. After solidification, the temperature of the alloy is permitted to drop to ambient levels.

A lead-copper alloy was made in accordance with the foregoing procedure and as set forth in greater detail in copending application U.S. Ser. No. 706,640, now U.S. Pat. No. 3,556,779. A standard amount of sodium carbonate and graphite powder were used in making this alloy, for example, 4.5 grams of sodium carbonate and 4.5 grams of graphite powder per pound of lead-copper. This alloy after formation was heated and atomized in accordance with conventional procedures to produce a powdered material. The powder alloy was pressed into a wafer under very high pressure, such as 2000 psi. The wafer was not sintered but had enough adhesiveness and rigidity to allow it to be handled for processing. The wafer was then immersed into a bath of molten aluminum, at approximately 700° C. This temperature is above the melting point of aluminum and, of course, higher temperatures may be used. Upon immersion of the lead-copper compact, the aluminum infiltrated into the interstices of the lead-copper particles, thus giving a dense and almost completely homogeneous alloy. By this method, it is possible to make a broad spectrum of alloys covering various proportions of the three elements involved. The alloy produced by this method had good physical properties and is suitable for many applications including those discussed throughout this specification. In the above embodiment, several alloys were made including those having from 15–20% up to 50% lead-copper alloy with the remainder being aluminum. Generally, higher or lower amounts of the lead-copper alloy may be used in this method by immersion of the lead-copper compact into molten aluminum. Although a 60:40, copper:lead alloy was used in this experiment, the amounts, of course, can be varied to incorporate greater or lesser amounts of lead in the final aluminum-lead-copper alloy. For example, the ratio of lead to copper can be varied from 5:95 to 95:5. However, the preferred copper-lead alloy contains about 20–50% lead, and the copper-lead-aluminum alloy preferably contains from 50 to 95% aluminum. The lack of segregation in the final alloy is quite good in view of the known difficulties of incorporating lead or copper in aluminum.

Another alloy having 60% copper and 40% lead was made with 4.5 grams of each of sodium carbonate and graphite per pound of alloy. The following alloys were then made by melting the aluminum, bringing it to the indicated temperature, adding a bar of coppr-lead alloy (except in run E, where the copper-lead alloy was powdered), and maintaining the temperature for the indicated time.

| Run | Percent Aluminum in Alloy Composition | Temperature | Time |
|---|---|---|---|
| A | 95 | 1200°C | 30 seconds |
| B | 80 | 1300°C | 1 minute |
| C | 70 | 1300°C | 1 minute |
| D | 70 | 1100°C | 30 seconds |
| E | 50 | 1300°C | 1 minute |

Each of the alloys showed good homogeneity with an aluminum matrix having dispersed therein a homogeneous copper-lead alloy.

This invention also comprises adding elemental copper and lead to molten aluminum. It is more difficult to obtain good homogeneity by this technique, particularly at the higher levels of copper and lead. This procedure is useful when the alloy contains from about 65 to 95% aluminum and the remainder substantially copper-lead in the ratios described above, preferably 20 to 50% lead based on the total amount of lead and copper. Homogeneity may be promoted by the use of high temperatures and additives.

In another embodiment, pure aluminum was superheated to 1000°C. Higher temperatures may also be used, such as about 1300°C. Approximately 5% lead, and 5% copper were then added with a standard amount of graphite and sodium carbonite, i.e., as above, 4.5 grams of each based on the total weight of copper and lead. The copper and lead may be added as separate solid particles or bars or preferably they are first heated to a molten condition and then added to a molten aluminum. The molten mixture is then held at this temperature for 1 or 2 minutes, or longer and then allowed to cool normally or alternatively can be quenched. The final product had good physical properties.

The following additional runs were made by melting aluminum to the indicated temperature, adding elemental copper and lead in a 60:40 ratio, and maintaining the temperature for the indicated time with stirring.

| Percent Aluminum in Alloy Composition | Temperature | Time |
|---|---|---|
| 80 | 1100°C | 30 seconds |
| 80 | 1300°C | 2 minutes |
| 70 | 1300°C | 2 minutes |

In place of the sodium carbonate and graphite, an additive of erbium hydride, from 1/3 to 5 percent of the total, may be added during the mixing operation as desired; this reduces the possible oxidation of aluminum and provides a mixing action within the molten mass. Another alternative is to make the pours in an inert atmosphere, such as by bubbling argon through the molten metal to eliminate the oxidation of aluminum.

The copper apparently helps keep the lead from precipitating out of the molten mixture and in this regard apparently augments the functions of the additive used. Moreover, it is obvious that the copper is also an element which produces further positive benefits in the alloy. The copper is beneficial to the mixture since it increases electrical and thermal conductivity of the alloy. Thus heat dispersion within the alloy is improved which is a beneficial property in its application in bearings and bushings. The alloy has many advantages that are found in conventional lead-copper alloys and is of lower cost and weight with comparable performance in several applications. Although aluminum is characteristically more brittle than copper, the displacement of the more expensive copper by the aluminum structure provides improved strength and hardness.

The alloy may be made in a crucible (which is also the mold) and melted by the use of an induction heater. In place of an induction heater, the alloy can also be produced by another method using a standard electric, gas or crucible oven preferably with a temperature range up to 1300°C. For the best results a vacuum oven or one which can be flooded with an inert gas should be used to prevent the alloy from oxidizing. The temperature of the oven should be brought to between 1000°C–1300°C when using the lead-copper alloy, and the desired amount of the aluminum is placed in the oven and kept there until it is in a completely molten state. At this time, the copper and lead are added thereto, along with an effective amount of the homogeneity producing agent when desired. This will be in the same ratio as previously described and will act in the same way to produce a homogeneous alloy. The molten aluminum, lead and copper alloy should remain in the oven for a few minutes to insure a completely molten state of the alloy.

When the alloy ingredients are not heated in the mold or crucible, the mold into which the molten alloy ingredients are to be poured may be preheated so that there will not be an instantaneous cooling and solidifying of the part of the molten metal that hits the cold surfaces of the mold while the rest of the alloy cools at a slower rate. All the alloy in the mold will be initially in the molten state as the mold is above the necessary temperature. Preferably, this can be accomplished by placing the mold in an oven. The mold, and the molten alloy therein, can then be cooled at a controlled uniform rate by merely reducing the oven temperature. The faster the rate of cooling for the alloy, the finer the resulting grain structure of the alloy. By uniformly cooling the molten mixture, an alloy with good homogeneity can be obtained. The homogeneity promoters described herein may also be used to make aluminum-lead alloys. From ½ to 5 percent of the homogeneity promoter, based on the total weight of the alloy, are used. For example, lead and the homogeneity promoter (graphite plus a metal compound, and/or erbium hydride) can be slowly added to molten aluminum, for example at about 800°C. These promoters improve the miscibility of the metal components by providing a mixing action. The lead may comprise from about five to thirty per cent by weight of the total alloy.

Alloys produced by the foregoing methods are intended for use where good anti-friction properties including a low coefficient of friction, high thermal conductivity and low resistance to electrical current are desired. In addition, an alloy made by the foregoing method can be fabricated by a variety of methods without losing the anti-friction qualities of the alloy. These qualities are believed to result from the lead and copper being well distributed throughout the metal body as small particles.

One application that the alloy of the present invention may be used for is as a bearing surface. The alloy of the present invention is especially suited for this application because of its previously mentioned anti-friction properties and additionally because of its resistance to fatigue or scoring under heavy loads, high speeds or high temperatures. The alloy may be in powder form and sprayed onto the hot surface. The heat from the surface will melt or sinter the powdered alloy creating a bond between the alloy and the surface which will be strong enough to resist the high stresses that result from bearing forces while providing the excellent bearing properties which are inherent in the alloy of the present invention. Alternatively, an aluminum alloy sheet can be bonded by hot rolling, for example to a backing sheet of steel. Another procedure is to bond other bearing alloys, such as lead-copper to the surface of the aluminum.

Still a further use of the alloy of the present invention is to combine the alloy, in powder form, with petroleum and mineral based lubricants such as greases and oils.

Once the alloy has been made, it can be placed in the molten state, cast or powdered, after the initial achievement of the alloy without undue segregation. This is a great advance over prior art alloys which did not maintain their homogeneity upon subsequently being placed in a molten state, cast or powdered.

The alloy of this invention comprises a matrix of aluminum with a fairly uniform dispersion of copper and lead therein. By adding a preformed homogeneous copper-lead alloy, made as defined herein and in earlier applications, to molten aluminum a maximum amount of lead and copper can be used without substantial segregation. The copper and lead can also be added in elemental form, in which case a homogeneity promoter is preferably used with superheated aluminum. The homogeneity promoter can be the combination of graphite and metal compound described above, or in place thereof, or in addition thereto, erbium hydride. The latter additive can also be used in conjunction with the preformed homogeneous copper-lead alloy.

This invention has been described in terms of specific embodiments set forth in detail. Alternative embodiments will be apparent to those skilled in the art in view of this disclosure, and accordingly such modifications are to be contemplated within the spirit of the invention as disclosed and claimed herein.

I claim:

1. The method of making an aluminum-copper-lead alloy which comprises melting aluminum and adding thereto a homogeneous copper-lead alloy and eribium hydride, wherein the copper-lead alloy contains about 20–50% lead, the aluminum-copper-lead alloy contains about 50–95% aluminum and from 1/3 to 5 percent of erbium hydride is added to said aluminum, for each part of each copper-lead alloy.

2. The method of claim 1 wherein the homogeneous copper-lead is made by adding an effective amount of a homogeneity promoter to a mixture of molten lead and copper, said promoter consisting essentially of elemental carbon and a compound of a metal selected from the group consisting of alkali metals, alkaline earth metals and rare earth metals in the form of an oxide or carbonate.

3. The method of making an improved aluminum-lead alloy which comprises melting aluminum and adding thereto lead and an effective amount of a homogeneity promotor, said promoter consisting essentially of erbium hydride, and said lead comprises about 5–30% by weight of the total alloy.

4. The method of making an alloy which comprises adding copper and lead and a homogeneity promoter to superheated aluminum at a temperature of about 1000°C, wherein said aluminum comprises about 50–95% of said alloy, and said lead comprises about 20–50% of the total amount of lead and copper, and said promoter consisting essentially of erbium hydride.

* * * * *